US008591725B2

(12) United States Patent
Sundaram et al.

(10) Patent No.: US 8,591,725 B2
(45) Date of Patent: Nov. 26, 2013

(54) DEPOSIT MITIGATION IN GASOLINE FRACTIONATION, QUENCH WATER SYSTEM AND PRODUCT RECOVERY SECTION

(75) Inventors: Kandasamy Meenakshi Sundaram, Old Bridge, NJ (US); Ujjal K. Mukherjee, Montclair, NJ (US); Ronald M. Venner, Franklin Lakes, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 444 days.

(21) Appl. No.: 12/757,384

(22) Filed: Apr. 9, 2010

(65) Prior Publication Data

US 2011/0247967 A1 Oct. 13, 2011

(51) Int. Cl.
*C10G 9/16* (2006.01)

(52) U.S. Cl.
USPC ..... 208/48 AA; 436/171

(58) Field of Classification Search
USPC ..... 208/48 AA
See application file for complete search history.

(56) References Cited

U.S. PATENT DOCUMENTS

| | | | | |
|---|---|---|---|---|
| 4,081,360 | A | 3/1978 | Tan et al. | |
| 4,381,987 | A | 5/1983 | Kuehler | |
| 5,132,225 | A * | 7/1992 | Dickakian | 436/60 |
| 5,139,088 | A | 8/1992 | De Boer et al. | |
| 5,156,975 | A | 10/1992 | Nelson | |
| 2004/0012782 | A1 | 1/2004 | Mason et al. | |
| 2004/0072361 | A1 * | 4/2004 | Varadaraj et al. | 436/142 |
| 2005/0263437 | A1 | 12/2005 | Howdeshell | |
| 2006/0014296 | A1 | 1/2006 | Brons et al. | |
| 2006/0014654 | A1 | 1/2006 | Varadaraj et al. | |
| 2010/0163461 | A1 * | 7/2010 | Wright et al. | 208/48 AA |

FOREIGN PATENT DOCUMENTS

| | | |
|---|---|---|
| JP | 64-036687 | 2/1989 |
| JP | 09118886 A | 5/1997 |

OTHER PUBLICATIONS

International Search Report and Written Opinion issued Dec. 27, 2011 in corresponding International application No. PCT/US2011/030505 (8 pages).

Canadian Intellectual Property Office, Office Action Report issued in Canadian Application No. 2769412, dated Feb. 6, 2013, (3 pages).

Written Opinion issued Jul. 12, 2013 in corresponding Singapore Application No. 201200535-1 (11 pages).

* cited by examiner

*Primary Examiner* — Randy Boyer
*Assistant Examiner* — Juan Valencia
(74) *Attorney, Agent, or Firm* — Osha • Liang LLP

(57) ABSTRACT

A method for selecting a solvent or mixture of solvents useful for mitigating deposit formation, cleaning existing deposits, and/or decreasing the rate of deposit formation is disclosed. Decreasing the rate at which deposits may form and/or increasing the rate at which deposits may be removed can dramatically improve process economics (e.g., decreasing down time as a result of deposit formation). In one aspect, embodiments disclosed herein relate to a process for dispersing foulants in a hydrocarbon stream, including the steps of: determining a nature of foulants in a hydrocarbon stream; selecting a solvent or a mixture of solvents suitable to disperse the foulants based upon the determined nature; and contacting the foulants with the selected solvent or mixture of solvents.

18 Claims, 1 Drawing Sheet

DEPOSIT MITIGATION IN GASOLINE FRACTIONATION, QUENCH WATER SYSTEM AND PRODUCT RECOVERY SECTION

FIELD OF THE DISCLOSURE

In one aspect, embodiments disclosed herein relate to mitigation of deposits or decreasing the rate of deposit formation as a result of foulants in various hydrocarbon streams, such as residuum fractions. More specifically, embodiments disclosed herein relate to a method for selecting a solvent or mixture of solvents useful for mitigating deposit formation, cleaning existing deposits, and/or decreasing the rate of deposit formation.

BACKGROUND

With an ever-increasing demand for low-sulfur middle distillates, refiners have taken a keen interest in converting vacuum residuum to distillates. The search for Best Available Technology ("BAT") has intensified over the last few years because of diminishing supplies of sweet crudes and incremental supplies coming predominantly from heavy sour crudes and heavy synthetic crudes.

Heavy crude generally refers to those crudes with high viscosity or an API gravity less than about 23. Crude oils and crude oil residuum derived from atmospheric or vacuum distillation of crude oil are examples of heavy crudes. The traditional outlet for vacuum residue was high sulfur fuel oil ("HSFO"), but HSFO demands in most regions have diminished over the last ten years giving further impetus to residue conversion processes.

One conversion technique of recent interest is resid or residuum hydrotreating. During resid hydrotreating, resid oil is upgraded with hydrogen and a hydrotreating catalyst to produce more valuable lower-boiling liquid products. Various catalytic residue-upgrading technologies are available from Chevron Lummus Global ("CLG") including atmospheric residue desulfurization (ARDS), vacuum residue desulfurization (VRDS), up flow reactor (UFR), online catalyst replacement (OCR) and the LC-FINING® process. The LC-FINING process integrated with the ISOCRACKING® process offers a proven high conversion option. The combined process is especially attractive in situations requiring high conversion of residuum with high metals content and where diesel demand is higher than gasoline demand.

During operation of such conversion processes, foulants can form solid hydrocarbonaceous deposits on the processing equipment and associated piping, presenting numerous problems for refiners. The foulants can stick together, adhere to the sides of vessels, and agglomerate. Once entrained into any product stream, foulants are also carried away into associated downstream equipment and piping.

The situation becomes even more aggravated when two or more hydrotreating processes are connected in series as is typically done in commercial operations. In such cases, foulants not only form nucleation sites for solids growth and agglomeration in the first process, but are carried over with the hydrotreated product stream into a subsequent process where additional deposits may form.

Deposits of foulants are well known for plugging piping and tubulars, choking off pipes by reducing areas of flow, creating poor flow regimes, and interfering with the function of equipment. For example, the foulants can abrade valves and other equipment, or can build up insulative layers on heat exchanger surfaces reducing the capability to transfer heat.

Continued buildup can necessitate equipment repairs, extended downtime, production shutdowns, and overall reduced efficiency and process yield.

Another aspect of foulants is that they may promote emulsions within the crude that can lead to much higher viscosities, making it difficult and challenging to pipeline the oil from one location to another. These effects are a substantial problem in heavy oil refining and transportation, and can significantly increase the costs of production to the point of removing any incentive to continue pursuit of the possible lucrative rewards of residuum conversion.

One type of foulant frequently found in heavy oil that is strongly attributable to sedimentation of deposits and high viscosity is asphaltenes. Asphaltenes are most commonly defined as a portion of crude oil that is insoluble in a low molecular weight paraffin (i.e., n-heptane, etc.), and have been found in crudes in quantities in excess of 20 percent. Asphaltenes are typically brown to black amorphous solids that are basically formed of condensed aromatic nuclei associated with alicyclic groups. In addition to carbon and hydrogen, the complex atomic structure can also include nitrogen, oxygen, and sulphur atoms. Particle size can range less than 0.03 microns to several thousand microns, and can be characterized as sticky or cohesive, and may agglomerate.

Asphaltenes are polar molecules which aggregate together through aromatic $\pi$-$\pi$ orbital association, hydrogen bonding, and acid-base interactions. They exist in the form of colloidal dispersions stabilized into thermodynamic equilibrium by other components in the crude oil. However, the equilibrium of the oil can be disrupted during a production process, or any other mechanical or physicochemical processing where changes in pressure, temperature and phase composition may occur. This destabilizes the asphaltene, leading to aggregation and deposition of the particles into the surroundings.

Many processes beneficial in the production of crude are limited because the processes also provide conditions beneficial to the formation of deposits. Various methods have been used to clean and prevent deposit formation, as well as to reduce viscosity of the heavy crudes. In one method, deposits are controlled by stringently controlling surrounding conditions. In U.S. Pat. No. 4,381,987, a hydrocarbon feedstream containing asphaltenes is hydroprocessed by passing the stream through a catalytic reaction zone in the presence of a catalyst bed. It is disclosed therein that plugging of the catalyst bed can be avoided by controlling the severity of the hydroprocessing conditions in the catalytic reaction, decreasing the likelihood of asphaltenes forming deposits. However, the environment outside of the reactor zone is not as predictable, and comparable control outside of the zone is unobtainable.

In U.S. Pat. No. 5,139,088, asphaltene precipitation in the flow path of an oil production well is claimed to be inhibited by injecting a heavy fraction of crude oil having a relatively high aromaticity and molar weight.

In U.S. Pat. No. 4,081,360, issued Mar. 28, 1978 to Tan et al., a light solvent is added to coal liquefaction fractions for suppressing the formation of asphaltenes.

A variety of chemical treatments are also disclosed in the art for affecting foulants including the use of dispersants and viscosity reducing agents. The dispersant-plus-solvent approach has been disclosed for affecting asphaltenes, and a variety of suitable dispersant compositions are known and available to the trade for this purpose, such as disclosed by U.S. Publication 2006/0014654. Asphaltene precipitation inhibitors have also been disclosed for use in continuous treatment or squeeze treatments of well formations.

However, feed sources can vary significantly in their composition, and individual dispersing agents and viscosity reducing agents can operate effectively only in a limited range. Even small changes in the oil composition can have a major effect on the dispersing properties for asphaltenes. Also, even though dispersants and precipitation inhibitors address the problem of slowing or preventing asphaltene precipitation, once deposits form, the use of such inhibitors is negated because the removal generally requires a cleaning, scraping or hydrotreating procedure to remove the deposits. This is undesirable as it usually requires a reduction or complete shut-down of production.

SUMMARY OF INVENTION

Embodiments disclosed herein relate to the mitigation of deposits or decreasing the rate of deposit formation as a result of foulants in various hydrocarbon streams, such as residuum fractions. More specifically, embodiments disclosed herein relate to a method for selecting a solvent or mixture of solvents useful for mitigating deposit formation, cleaning existing deposits, and/or decreasing the rate of deposit formation. Decreasing the rate at which deposits may form and/or increasing the rate at which deposits may be removed can dramatically improve process economics (e.g., decreasing down time as a result of deposit formation).

In one aspect, embodiments disclosed herein relate to a process for dispersing foulants in a hydrocarbon stream. The process may include the steps of: determining a nature of foulants in a hydrocarbon stream; selecting a solvent or a mixture of solvents suitable to disperse the foulants based upon the determined nature; and contacting the foulants with the selected solvent or mixture of solvents.

In another aspect, embodiments disclosed herein relate to a process for affecting a condition of foulants in a hydrocarbon stream, including: feeding a hydrocarbon stream to a refining process; determining a nature of foulants in the hydrocarbon stream; establishing input parameters and input components for a thermodynamic model, wherein the model results are used to select a mixture of hydrocarbons suitable to affect the foulants in a desired manner based upon the determined nature; contacting the foulants with the selected mixture.

Other aspects and advantages will be apparent from the following description and the appended claims.

DETAILED DESCRIPTION

Figure 1:
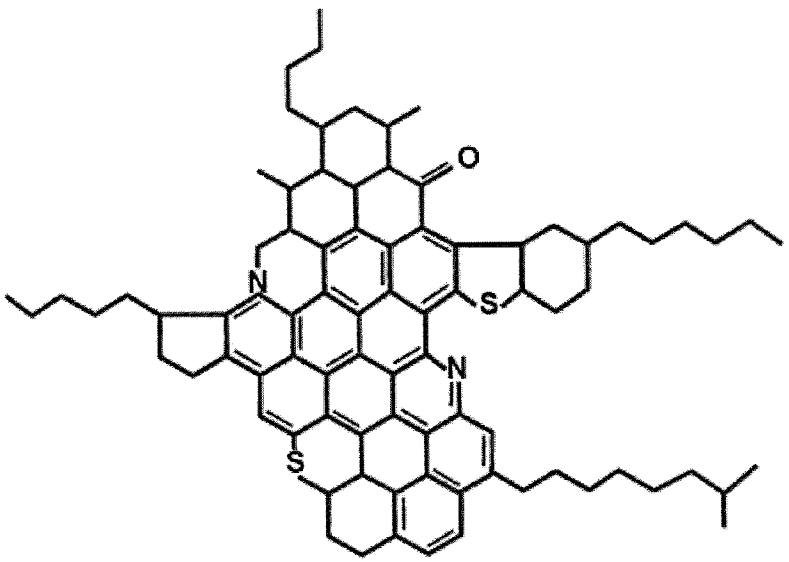
FIG. 1 is a proposed chemical structure representing asphaltene

Embodiments disclosed herein relate to the processing of hydrocarbon streams containing foulants, such as asphaltenes and other asphaltene-like compounds. Asphaltenes, in general, refers to a class of compounds, and not a pure component. They consist of tens of thousands of chemical species and the composition is not well defined. In addition, they appear to interact with each other and the other oil constituents in a complex manner. The multiple hypothetical structures proposed for asphaltenes lead to different, inconsistent modeling approaches. One proposed structure for an asphaltene is illustrated in FIG. 1.

Hydrocarbon streams containing foulants may come from a variety of sources, including well-head condensates, crude oil, heavy crude oil, synthetic crudes, crude petroleum oils, atmospheric or vacuum residua, topped crudes, reduced crudes or fractions thereof. The sources can also contain other suspended matter such as added catalysts or contact materials. In other examples, the feed source can include coal/solvent or coal/petroleum mixtures, coal-derived liquids containing suspended coal-derived solids (e.g., ash), hydrocarbonaceous liquids derived from bituminous, subbituminous or brown coals or lignite, hydrocarbonaceous liquids derived from oil shale, e.g., retorted shale oil, and other hydrocarbonaceous liquids derived from other mineral sources such as tar sands, gilsonite, etc. The source can also originate from an upstream processing step, such as a vacuum tower, atmospheric tower, or an ebullated reactor bed, or alternatively, the source can originate from a subterranean formation.

Foulants present in a hydrocarbon stream can be described as existing in various conditions that can include solubilized, precipitated, dispersed, suspended, or at equilibrium. In its natural state, for example, residuum may contain dispersed foulants. However, during various processes (such as pumping, transporting, heating, cooling, distilling, reacting, condensing, boiling, etc.), the stability of the foulants in the hydrocarbon stream may be disturbed due to changes in pressure, temperature, chemical make-up of the stream, and other factors. Once disturbed, the foulants can readily form deposits on equipment and associated piping.

Embodiments disclosed herein relate generally to methods for preventing, inhibiting, suppressing, removing, cleaning, dispersing, mitigating, solubilizing, etc., deposits that have been or may be formed by foulants contained in a hydrocarbon stream. Use of processes disclosed herein may allow for one or more of: efficient cleaning/removal of deposits from piping and equipment, the in situ removal of deposits while operating a chemical process, and decreased deposit formation during operation of a chemical process. Embodiments disclosed herein remedy the shortcomings of the previously noted inconsistent modeling approaches, providing a method to effectively process hydrocarbon streams containing foulants.

More specifically, embodiments disclosed herein relate to a method for selecting a solvent or mixture of solvents useful for mitigating deposit formation, cleaning existing deposits, and/or decreasing the rate of deposit formation.

Figure 2:
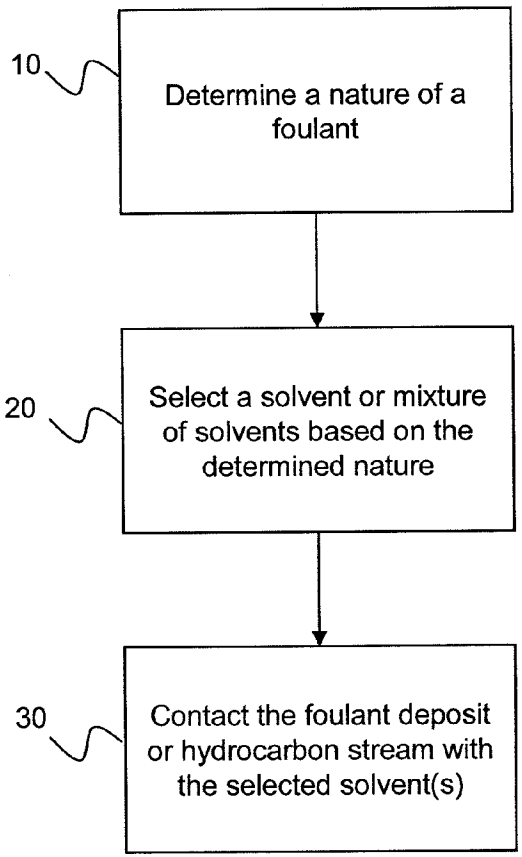
FIG. 2 is a general flow diagram showing a process for dispersing foulants according to embodiments disclosed herein.

Referring now to FIG. 2, a process for affecting a condition of foulants in a hydrocarbon stream according to embodiments disclosed herein may include the steps of: determining a nature of foulants in a hydrocarbon stream (10); selecting a solvent or a mixture of solvents suitable to disperse the foulants based upon the determined nature (20); and contacting the foulants with the selected solvent or mixture of solvents (30).

In process step 10, the nature of the foulants is determined. As used herein, "nature" refers to properties of the foulant that influence the propensity of the foulant to form deposits. The nature of the foulants may be determined using analytical techniques, such as performing various tests on the hydrocarbon stream or a sample of a deposit formed when using the hydrocarbon feedstock. Such tests may include mass spectrometry, gas chromatography, gel permeation chromatography (molecular weight, molecular weight distribution, etc.), bromide test, iodine test, viscosity, the Shell Hot Filtration Test, metals content, pentane, heptane and/or toluene insolubles, Conradson Carbon Residue (CCR), API gravity, NMR spectroscopy, elemental analysis (content of carbon, hydrogen, sulfur, nitrogen, oxygen, etc.), distillation properties, as well as other techniques useful for measuring sediments, physical properties, or chemical properties of a hydrocarbon stream.

Properties of the foulants may also be determined or estimated using empirical techniques. The above analytical tests may be useful to calculate or estimate additional properties of the foulant, where various properties may be correlated through empirical data or may be estimated using various thermodynamic equations. The estimated properties may include predicted values for those tests mentioned above, as well as others, such as solubility parameter or average solubility parameter, kinetic parameters, the saturates, aromatics, resins, asphaltenes (SARA) balance, hypothethical structures, mass or mole fractions of foulants in a hydrocarbon stream, activity coefficients, energy of vaporization, fusion, or sublimation, and aromaticity, among others.

The properties of a chemical may also vary with temperature and/or pressure. In some embodiments, various properties of the foulant as a function of temperature or pressure may be estimated.

After determining a nature of the foulants in step (10), a mixture of solvents suitable to disperse (i.e., solubilize, suspend or stabilize in solution, etc.) the foulant may be selected, based on the determined nature, in step (20). Components useful as the selected solvent or in forming a mixture of solvents may include aliphatic solvents, alicyclic solvents, aromatic solvents, gasolines, kerosenes, diesel fuels, aviation fuels, marine fuels, naphthas, gas oils, distillate fuels, oils, medium cycle oil (MCO), light cycle oil (LCO), flux oil, heavy cycle oil (HCO), deasphalted oil (DAO). The solvent or mixture of solvents may include hydrocarbons or hydrocarbon mixtures containing di-aromatic (tri-aromatic, etc.) compounds with hydrogen to carbon ratios similar to or less than the hydrogen to carbon ratio of the overall hydrocarbon feed in some embodiments (overall H/C ratio for hydrocarbon stream 10, for example). In other embodiments, the solvent or mixture of solvents may include hydrocarbons or hydrocarbon mixtures containing di-aromatic (tri-aromatic, etc.) compounds with hydrogen to carbon ratios similar to or less than the hydrogen to carbon ratio of the foulant. In some embodiments, the solvent or mixture of solvents may comprise one or more of di-aromatic compounds, tri-aromatic compounds, and combinations thereof.

The suitability of a solvent or mixture of solvents to disperse a foulant may be a function of one or more chemical and physical properties of the solvent(s), including molecular weight, aromaticity, aliphaticity, olefinicity, hydrogen to carbon ratio, polarity, presence of heteroatoms/functional groups, and viscosity, among others. The suitability of a solvent or mixture of solvents to disperse a foulant may also be temperature and pressure dependent. The properties of solvent(s) may be measured, uploaded, adapted, input, or estimated based on analytical methods, empirical methods, or literature data.

The properties of one or more solvents may then be used to select a solvent or mixture of solvents that are capable of dispersing the foulant. Properties of a mixture of solvents may be estimated, for example, as a function of the various mass or molar fractions of each solvent used in the mixture.

Suitability of a solvent or solvent mixture to disperse a foulant, in some embodiments, may be a function of the expected interaction(s) between the solvent and the foulant. Expected interactions may include pi-bonding, hydrogen-bonding, and attraction through Van der Waals forces (e.g., similarities in aromaticity, aliphaticity, olefinicity, presence of heteroatoms and/or functional groups), formation of micelles, and suspension of a foulant in a solvent having a sufficient viscosity, among others. For example, in some embodiments it may be beneficial or preferred to have a similar hydrogen to carbon ratio or range of hydrogen to carbon ratio for both the solvent and the foulant. In other embodiments, it may be preferred for the solvent to have a lower hydrogen to carbon ratio than that of the foulant.

Selecting (20), may thus include: determining one or more properties of the foulant; and determining one or more desired properties of the solvent or mixture of solvents based on the determined property(ies) of the foulant. The desired properties of the solvent(s) may then be used to iteratively determine a solvent or mixture of solvents having the desired property(ies).

Following selection of the solvent in step (20), the selected solvent or mixture of solvents may be formed, such as by admixture, and contacted (30) with the foulant or the hydrocarbon stream to effectively disperse the foulant during operation of a process, to clean/remove deposits from piping and equipment, for in situ removal of deposits while operating a chemical process, and/or to decrease deposit formation during operation of a chemical process.

For a given chemical process, one or more of the above steps may be repeated on a periodic basis. Feed sources can vary significantly in their composition over time, and even minor changes in composition may dramatically affect the propensity of a foulant to form deposits on equipment and piping. Additionally, these minor changes in composition may also affect the suitability of a selected solvent or mixture of solvents to effectively disperse the foulant. Operating conditions for reactors may also change over time, such as ramping up of temperatures to account for catalyst deactivation, and such changes may also affect the suitability of a solvent or the propensity of the foulant to form deposits. Accordingly, the periodic adjustment of the selected solvents may be necessary. Similarly, when using a selected solvent mixture to periodically clean fouled equipment and piping, one or more of the above steps may be repeated to match the selected solvent mixture to the foulant deposit currently being cleaned.

As noted above, feed sources can vary significantly in their composition over time. When cleaning pipes or other fouled equipment according to embodiments disclosed herein, the deposits to be cleaned may thus be from a variety of feedstocks. In such instances, solvents useful for removing foulants from one feed may not be useful in removing foulants from a second feed. In such instances, historical performance or engineering judgement may not be sufficient, whereas determining a nature of the foulant and selection of a solvent mixture according to embodiments disclosed herein may enable efficient removal of the accumulated deposit.

When operating a given chemical processes, it may be desired to contact the selected solvent mixture with the hydrocarbon stream in only a portion of the process, such as where a high propensity for fouling may occur, as may be recognized based on historical operating experience. In such instances, the selected solvent mixture may be contacted with the hydrocarbon stream upstream of that portion of the process. For example, a selected solvent mixture may be fed upstream of heat exchangers, flash or distillation columns, reactors, etc., to maintain the foulant as dispersed, and then the selected solvent mixture may be subsequently flashed or otherwise separated from the hydrocarbon stream for recycle and reuse.

Contacting of the foulants with the selected mixture can be done in any fashion that allows the foulants to interact with the selected mixture. In an embodiment, the selected mixture can be contacted with the foulants by flowing the selected mixture through, over, upon or across a surface having foulants. In an additionally embodiment, the selected mixture can also be contacted with the foulants by flowing the mixture through fouled equipment, where fouled equipment (5) can include any equipment used within a refinery process, such as pumps, filters, separators, heat exchangers or storage tanks.

For example, the selected mixture can be pumped through a piping network to contact foulants deposited onto a pipe surface. As another example, the selected mixture can be passed through the tubes of a heat exchanger where the foulants may already exist as a deposit. In an alternate embodiment, the selected mixture can contact foulants found within a fluid. For example, the fluid can be a crude oil, and the selected mixture can be added to the crude oil so the selected mixture can contact the foulants.

A selected mixture of hydrocarbons can be a single component or a plurality of components, and can be in any phase. In an embodiment, the mixture can be a mixture of fluids that may include non-aqueous fluids, aqueous fluids, or combinations thereof. In another embodiment, the selected mixture can include a solvent made of polycyclo aromatic heterorings. In yet another embodiment, the selected mixture can include a polar solvent, where the polar solvent can be aromatic solvents, oxygenated solvents, chlorinated solvents, or mixtures thereof. In still another embodiment, the selected mixture may include at least an aliphatic solvent, an aromatic solvent, or combinations thereof. And in yet another embodiment, the selected mixture can also include at least one of a viscosity reducing agent component, a polar solvent component, a dispersant component, or combinations thereof.

Due to the varying properties of the foulants within a given hydrocarbon stream, a single solvent may not be suitable to effectively disperse the foulants. In some embodiments, the selected mixture is synergistic, where the mixture includes at least two components, which on their own do not affect the condition of foulants in a desired manner to the degree that they do when selectively mixed together. Although similar solvents may have been indicated in the past as useful, to a degree, selecting a mixture of solvents according to embodiments disclosed herein may be useful to affect a greater amount of the foulant than would be expected based on the prior use of a solvent alone.

Selection of solvents or a mixture of solvents according to embodiments disclosed herein may be useful for various refining or hydrotreating processes, or portions thereof, including fixed bed hydrotreaters, slurry bed hydrotreaters, entrained bed hydrotreaters, hydrovisbreaking, ebullated bed hydrotreaters, and the like. Such processes may include fractionation systems including gasoline fraction sections, quench systems (aqueous or otherwise), product recovery sections, ethylene units, hydrocracking processes, an LC-FINING™ process, a catalytic-residue upgrading process, fractionators, atmospheric towers, vacuum towers, various reactor trains, associated piping, associated circuits, or combinations thereof.

As described above, properties of a foulant, measured and/or correlated, are used to select a solvent or mixture of solvents suitable for dispersing the foulant. Various simulation programs may be useful in expediting the selection process, where these programs may be proprietary or commercially available, such as ASPEN, PRO/II, and HYSIS, among others. Various physical and chemical properties of various chemicals/components may be provided with such simulation programs; such programs may additionally allow for manual input, modification, or programming of various parameters to facilitate the determination of the nature of the foulant, and the selection of a solvent or mixture of solvents as described above.

As an example of the method for dispersing a foulant according to embodiments disclosed herein, a hydrocarbon stream containing asphaltenes is processed over an extended run, resulting in formation of a deposit. The nature of the deposit is determined, indicating that the foulant has a hydrogen to carbon atomic ratio of about 1.5, a molecular weight ranging from about 700 amu to about 1100 amu, and contains a mixture of aromatic and alicyclic components, among other estimated and determined properties. Desired solvent properties may include a similar hydrogen to carbon atomic ratio, as well as a similar mixture of aromatic and aliphatic components. In some embodiments, the selected mixture of solvents may have a lower H/C atomic ratio as compared to the hydrocarbon feed containing the foulant or even lower than the foulant itself. The mixture of solvents selected may include a mixture of medium cycle oil, having a H/C atomic ratio of about 1.1 to about 1.2, deasphalted oil, having a H/C ratio of about 1.7, and a hydrotreated diesel, having a H/C ratio of about 1.9. The selected mixture of solvents is blended such that the mixture contains aromatic and alicyclic components at a similar ratio to that of the foulant, and a similar H/C ratio to that of the foulant, and a similar solubility parameter to that of the foulant. The selected mixture of solvents is thus synergistic with respect to treating the foulant as compared to any of the individual solvents alone. Contacting the deposit/foulant with the selected mixture results in efficient dispersion and removal of the foulant from the equipment.

Selection of the most suitable mixture according to embodiments disclosed herein provides improved process efficiency, effectiveness, and increased economic incentive. Advantageously, contacting the foulants with a properly selected mixture provides the benefit of reducing and removing fouling in a more effective and economical manner. When pressure drop is reduced by improving flow regimes or by reducing fluid viscosity, less energy is required to transfer fluids resulting in a reduction of energy costs. Further, removing foulants from heat transfer surfaces allows the surface to function closer to original design criteria and provide greater heat transfer, resulting in additional reduction of energy costs.

Desirably, treated streams are efficiently and safely pipelined through valves, outlet orifices, pumps, heat exchangers, and other associated equipment. Overall benefits include increase in capacity, increase in equipment life, and increase in equipment run-time. The disclosed invention may also beneficially include the ability of selecting mixtures with utility as affecting foulants in other fluids besides crude oil.

Also advantageously, when the foulants are properly affected in a conversion process, the operating temperature is increased so greater conversion is achieved without subsequent increases in foulant deposition. Cumulatively, the reduction in costs and increase in conversion equates to higher productivity and higher profit.

Although the present invention has been described in detail with reference to particular embodiments, those are intended to be illustrative of the invention and not offered in limitation thereof. Additional modifications to the described embodiments and further variations will be readily apparent to those skilled in the art and such further embodiments are made without departing from the spirit and scope of the invention as set forth in the following claims.

What is claimed is:

1. A process for dispersing foulants in a liquid hydrocarbon stream, the process comprising the steps of:

determining a nature of foulants in a liquid hydrocarbon stream by measuring a value of the liquid hydrocarbon stream and estimating a hydrogen to carbon ratio of the liquid hydrocarbon stream based on the measured value;

selecting a solvent or a mixture of solvents suitable to disperse the foulants based upon the determined nature, wherein a hydrogen to carbon ratio of the selected solvent or mixture of solvents is less than the estimated hydrogen to carbon ratio of the liquid hydrocarbon stream; and contacting the foulants with the selected solvent or mixture of solvents.

2. The process of claim 1, wherein the determining a nature of the foulants comprises at least one of:

analyzing a deposit formed as a result of processing the hydrocarbon feed stream to establish at least one input parameter for a model used for selecting the mixture; and analyzing the hydrocarbon stream to establish at least one input parameter for a thermodynamic model used for selecting the mixture;

wherein the at least one input parameter includes at least one of:

an average molecular weight of the foulant;

API gravity;

a measured sediment value of the foulant;

a hydrogen to carbon atomic ratio of the foulant;

a concentration of the foulant in the hydrocarbon stream a sediment concentration (a predicted Shell Hot Filtration Test value that is used to predict the maximum content of foulants) in the feed stream.

3. The process of claim 2, further comprising:

estimating at least one property of the foulant based upon the determined nature;

wherein the at least one property includes at least one of:

an average molecular weight of the foulant;

a molecular weight distribution of the foulant;

a solubility parameter of the foulant;

a calculated sediment value of the foulant;

an aromaticity of the foulant;

an olefinicity of the foulant.

4. The process of claim 3, wherein the selecting comprises at least one of:

determining a thermodynamic property of the foulant based on at least one of the at least one input property, the at least one estimated property, and a process condition;

determining a desired thermodynamic property of the mixture of solvents based on the determined thermodynamic property;

calculating a thermodynamic property of one or more solvents based upon at least one of one or more determined input properties and one or more estimated properties;

iteratively determining a solvent or mixture of solvents having the desired thermodynamic property.

5. The process of claim 1, wherein the mixture of solvents comprises at least one of an aliphatic solvent, an aromatic solvent, diesel, medium cycle oil (MCO), light cycle oil (LCO), flux oil, deasphalted oil (DAO), and heavy cycle oil (HCO).

6. The process of claim 5, wherein the mixture of solvents comprises at least two of an aliphatic solvent, an alicyclic solvent, an aromatic solvent, diesel, medium cycle oil (MCO), light cycle oil (LCO), flux oil, deasphalted oil (DAO), and heavy cycle oil (HCO), wherein the selected components of the mixture are synergistic for dispersing foulants.

7. The process of claim 6, wherein the mixture of solvents comprises di-aromatics with a hydrogen to carbon ratio lower than a hydrogen to carbon ratio of the foulant.

8. The process of claim 6, wherein the mixture of solvents comprises di-aromatics with a hydrogen to carbon ratio lower than a hydrogen to carbon ratio of the hydrocarbon stream.

9. The process of claim 6, wherein the mixture of solvents comprises one or more of di-aromatic compounds, tri-aromatic compounds, and combinations thereof.

10. The process of claim 1, wherein the contacting comprises at least one of:

admixing two or more solvents to form the selected mixture;

feeding the selected mixture through equipment containing a deposit formed by the foulant, thereby dispersing at least a portion of the foulant into the selected mixture and reducing a size of the deposit; and admixing the selected mixture with the hydrocarbon stream, thereby decreasing a rate of deposit formation when processing the hydrocarbon stream.

11. The process of claim 10, further comprising at least one of:

separating the selected mixture from at least one of the hydrocarbon stream and the foulant from a resultant mixture that occurs due to the contacting; and recycling at least a portion of the selected mixture to the contacting.

12. A process for affecting a condition of foulants in a liquid hydrocarbon stream, comprising:

a. feeding a liquid hydrocarbon stream to a refining process;

b. determining a nature of foulants in the liquid hydrocarbon stream by measuring a value of the liquid hydrocarbon stream and estimating a hydrogen to carbon ratio of the liquid hydrocarbon stream based on the measured value;

c. establishing input parameters and input components for a thermodynamic model, wherein the model results are used to select a mixture of hydrocarbons suitable to affect the foulants in a desired manner, based upon the determined nature, wherein a hydrogen to carbon ratio of the selected mixture of hydrocarbons is less than the estimated hydrogen to carbon ratio of the liquid hydrocarbon stream;

d. contacting the foulants with the selected mixture.

13. The process of claim 12, wherein a hydrogen to carbon ratio of the selected mixture is in the range from about 1:1 to about 2:1.

14. The process of claim 13, and wherein the hydrogen to carbon ratio of the selected mixture is less than a hydrogen to carbon ratio of the foulant.

15. The process of claim 13, and wherein the hydrogen to carbon ratio of the selected mixture is less than a hydrogen to carbon ratio of the hydrocarbon stream.

16. The process of claim 12, wherein the contacting occurs in a refining process including at least one of a gasoline fraction section, a quench water system, a product recovery section, an ethylene production unit, a hydrocracking process, a hydrotreating process, a catalytic-residue upgrading section, a hydrotreater, a fractionator, an atmospheric tower, a vacuum tower, a reactor train, a heat exchanger, associated piping thereof, and combinations thereof.

17. The process of claim 16, wherein the contacting mitigates deposition of the foulant during operation of the refining process.

18. The process of claim 16, wherein the contacting removes at least a portion of deposited foulant from at least one of equipment and piping in the refining process.

* * * * *